United States Patent [19]

Schott

[11] 4,022,136

[45] May 10, 1977

[54] DESK FOR PHYSICALLY HANDICAPPED PERSONS

[76] Inventor: James G. Schott, 1723 Robb No. 50, Lakewood, Colo. 80215

[22] Filed: June 14, 1976

[21] Appl. No.: 695,528

[52] U.S. Cl. ..... 108/108; 108/152; 297/153; 297/174; 248/244

[51] Int. Cl.[2] ..... A47B 39/00

[58] Field of Search ..... 108/108, 43, 50, 152, 108/144, 107, 48, 113, 112; 297/148, 135, DIG. 4, 174, 157, 153, 154; 248/244, 243; 312/235, 239

[56] References Cited

UNITED STATES PATENTS

| | | | |
|---|---|---|---|
| 826,805 | 7/1906 | Scheibner | 108/144 |
| 950,944 | 3/1910 | Moore | 297/174 X |
| 1,719,270 | 7/1929 | Kline | 297/174 |
| 2,468,856 | 5/1949 | Alexander | 108/144 X |
| 2,941,775 | 6/1960 | Arnit | 248/243 |
| 3,094,080 | 6/1963 | Shannon | 108/144 X |
| 3,515,429 | 6/1970 | Bollinger | 297/153 |
| 3,575,466 | 4/1971 | Thomas | 297/135 X |
| 3,842,759 | 10/1974 | Thomas | 108/43 X |

*Primary Examiner*—Francis K. Zugel

[57] ABSTRACT

The desk is constructed for ease and convenience in positioning and use by handicapped persons who are confined to wheel chairs. It includes a relatively small base and a vertical panel extending across the base and rigidly secured thereto. Vertically extending retaining means are provided on one or both sides of the panel and a work table is removably secured to the retaining means at a selected level to accommodate varying sizes of wheel chairs. The table is considerably longer than wide, and a first narrow end is secured to the panel. The second, free end is provided with a recess in its central portion to receive the torso of the user and to define a pair of arm rests for working convenience. There are no obstructions beneath the table and its extra length provides room for a patient with a full leg cast.

20 Claims, 16 Drawing Figures

DESK FOR PHYSICALLY HANDICAPPED PERSONS

BACKGROUND OF THE INVENTION

The aparatus of this invention lies in the field of desks for handicapped students or other workers who are confined to wheel chairs and is directed to such desks which are readily portable and which are arranged to facilitate positioning of the user in working relation and ease and convenience in use. It is more particularly directed to such a desk which is readily movable to the location of the user, which is adjustable in height to correspond to the size of the wheel chair, which provides adequate unobstructed space for reception of the forward portion of the wheel chair and for the legs of the user, and which is arranged to stabilize the relation of the wheel chair to the desk during use.

Many persons who are confined to wheel chairs temporarily or for extended periods of time have need for a desk or work table for study and writing, or for physical therapy, or even for light production work on small parts with hand tools. For such people a conventional office type desk is quite unsuitable because the chair opening is too narrow to admit a wheel chair. Also the desk top is too low to admit a wheel chair even if it is not equipped with a center drawer. Moreover it is heavy and cumbersome and cannot readily be moved to locations suitable for use.

Various special purpose desks and tables have been made from time to time for use in particular operations but they normally are also quite large and not suited to being moved about frequently, as well as having low work tops which would obstruct an arm chair. One type which has been proposed has what could be called an overhanging top with no floor level obstructions across the front but the top is very deep to provide storage space and thus has very small vertical clearance and has fore and aft extending supports at its side edges.

To be suitable for the intended purpose, a desk should be light and mobile, the space beneath the work table should be free of obstructions including the side edges, should be adjustable vertically for use with wheel chairs of varying heights, and should have an adequate fore and aft extent for use by an occupant having a full leg cast. In addition the work table should be dismountable for storage in minimum space.

SUMMARY OF THE INVENTION

The apparatus of the present invention overcomes the disadvantages mentioned above and provides a desk which is particularly suitable for use by wheel chair occupants.

Generally stated, the apparatus includes a generally horizontal base mounted on rollers for easy mobility and a generally planar suport member extending across the base and rigidly secured thereto in vertical attitude. One or both faces of the support member may be provided with vertically extending retaining means, and work table in the form of a thin panel is provided for mounting on the support member. The work table is elongate with two narrow ends and two side edges which are considerably longer, preferably in the range of 150% to 200 percent of the length of the ends.

Connectors are provided at a first narrow end which disengageably engage the retaining means at selected levels to hold the work table at a desired elevation in a substantially horizontal attitude. The free end of the work table is provided with a centrally located recess of suitable size to accommodate the torso of the occupant of the wheel chair and to define an arm rest at each side. With the table set at an apporpriate elevation, the desk may be moved to the vicinity of the user, or he may move the wheel chair to the vicinity of the desk. The wheel chair is then rolled toward the desk until the user is located with his torso in the recess and the arm rests overlie the arms of the wheel chair. Since the user's arms will be on the arm rests, the engagement will tend to stabilize the arm chair against inadvertent displacement. The interengagement between the connectors and the retaining means is preferably designed so that the free end of the table may be tilted up and down one or two inches about a lateral axis adjacent to the support member. Consequently the table may be initially adjusted so that after the user is in working position the arm rests will swing down into contact with the arms on the arm chair and more positively hold the desk and chair in the desired relation.

The width of the work table is adequate for the work to be done without excessive side overhang and its length is great enough to allow a user with full leg cast to move into position in the recess. The total length of the base is only a minor portion of the length of the work table so that there are no floor obstructions beneath the outer portion of the table, and there are no side supports so that a non-handicapped person may move a chair into close position at either side of the table to engage in instruction or physical therapy. It has been determined that suitable dimensions for the planform of the table are a width in the range of 24 to 28 inches and a length in the range of 42 to 48 inches. For purposes of storage, the table may be dismounted and set with its free end down on the base with the arm rests engaging the sides of the base to hold it in stable condition.

BRIEF DESCRIPTION OF THE DRAWINGS

Various other advantages and features of novelty will become apparent as the description proceeds in conjunction with the accompanying drawings, in which.

DESCRIPTION OF PREFERRED EMBODIMENTS

Figure 1:
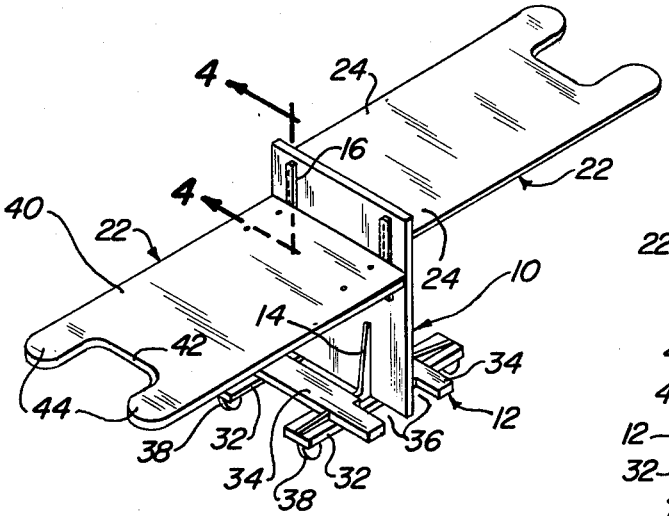
FIG. 1 is a perspective view of the desk of the invention ready for use by two persons.
Figure 2:
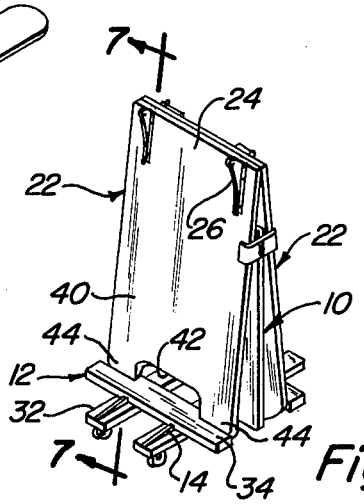
FIG. 2 is a perspective view of the desk with the work tables dismounted and set in storage position.
Figure 5:
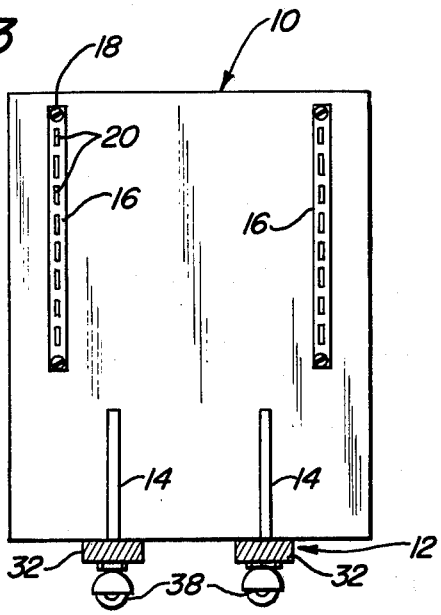
FIG. 5 is an elevational view, partly in section, taken on line 5—5 of FIG. 3, showing the support means mounted on the base, and the retaining means.
Figure 6:
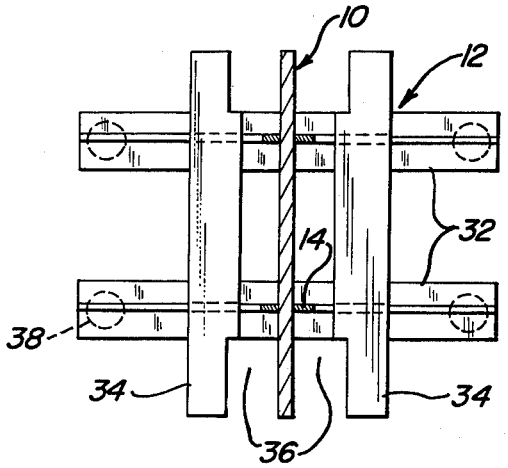
FIG. 6 is a sectional view taken on line 6—6 of FIG. 3.
Figure 7:
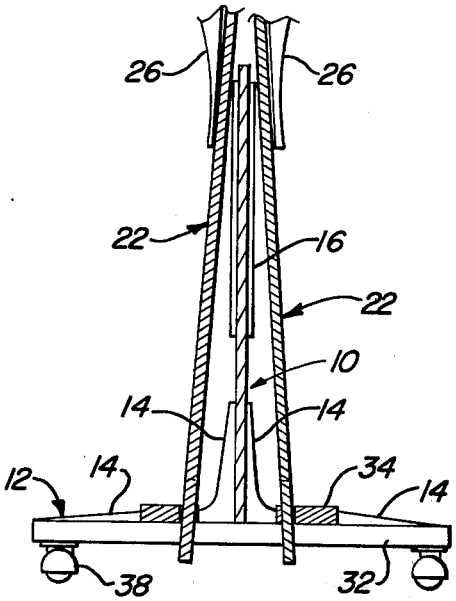
FIG. 7 is a sectional view taken on line 7—7 of FIG. 2.

The apparatus of the invention is schematically illustrated in operative condition in FIG. 1, in which an upright support member 10 in the form of a panel is rigidly attached in vertical attitude to a generally horizontal base 12 by means of a plurality of brackets 14. Although its position may vary, it preferably extends across the central portion of the base as shown. As best seen in FIG. 5, both faces of the panel are provided with a pair of laterally spaced vertically extending retaining means 16, each in the form of a U-shaped channel secured to the panel by screws 18 and provided in their base or forward walls with a series of vertically spaced apertures 20.

Figure 3:
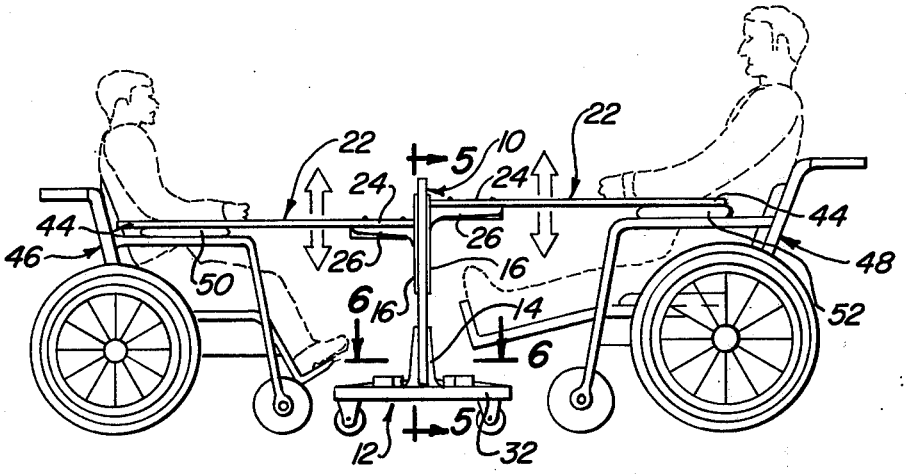
FIG. 3 is a side elevational view of the desk with the work tables in position for use by persons of different stature.
Figure 4:
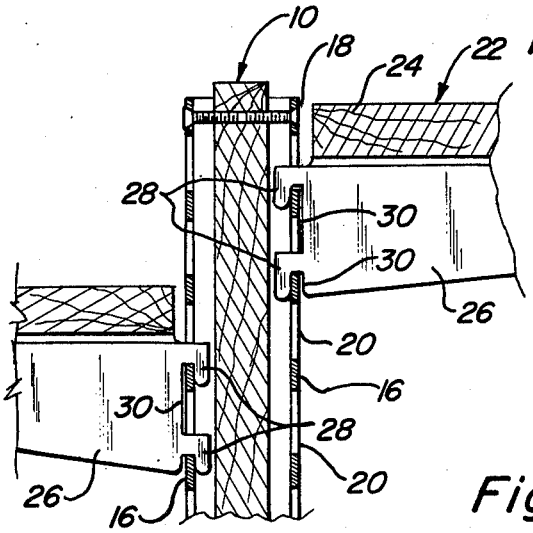
FIG. 4 is a sectional view on line 4—4 of FIG. 1 showing the construction of one of the connectors and the corresponding retaining means.

An elongate generally rectangular work table 22 may be secured to one face or each face of the support member 10 by means of detachable connectors and is held in substantially horizontal position at a selected elevation for use by an occupant of a wheel chair, as illustrated in FIG. 3. The table is in the form of a thin flat panel substantially free of obstruction on its under side and is substantially longer than it is wide, the length preferably being in the range of 150 to 200 percent of the width. A first narrow end 24 is provided with a pair of connectors 26 spaced laterally to correspond with the spacing of support rails 16 and secured to its under side. Each connector is provided with protuberances in the form of a pair of hooks 28 spaced to engage in a pair of spaced apertures 20 in the rail. The hooks may be engaged in any pair of apertures to locate the work table at a selected elevation. The spacing of the hooks from the body of each connector is somewhat greater than the thickness of the wall of the rail to define a small gap 30 to provide a small amount of play, allowing a limited range of tilting of the free end of the table about a lateral axis adjacent to the support member for a purpose to be described later.

The base 12, of generally rectangular planform, may be made of any suitable material, such as heavy rigid plywood, but it is presently preferred to make it of dual cruciform shape as shown using standard two by four lumber. It comprises a pair of laterally spaced longitudinally extending support bars 32 and a pair of laterally extending cross bars 34 rigidly secured to the longitudinal bars by nails or screws to produce a rigid structure. Although the work support panel 10 may be secured at or near the ends of bars 32 to produce a single desk it preferably extends across the central portion of bars 32 to produce a dual desk. Each cross bar extends across the longitudinal baras at each side of panel 10 and in a position spaced from and parallel to the bottom of the panel to define a recess or gap 36 at each side of the base between the panel and the cross bar. Rollers 38 are provided at the ends of each longitudinal bar 32 to provide easy mobility of the unit.

The second, free end 40 of the work table is formed with a recess 42 of sufficient width and depth to accommodate the torso of a wheel chair occupant who uses the desk, and the recess cooperates with the side margins to define an outwardly extending arm rest 44 at each side. This provides support and comfort for the user and makes the working area of the table more readily accessible. As will be observed in FIG. 3, the occupants of wheel chairs 46 and 48 are positioned in the recesses 42 so that their arms are on the arm rests and the working area of each table is in ready reach.

The versatility of the desk is apparent in FIG. 3, where the work table on the left is at the proper elevation for the small arm chair 46 while the work table on the right is adjusted to a higher level for the large arm chair 48. Contact of the occupant's arms with the arm rests tends to maintain a stable positional relation between the work tables and the wheel chairs. A further feature is that the limited tilting freedom of the free ends of the tables permits them to be adjusted to the selected position on support rails 16 and then tilted sufficiently to allow the wheel chairs to be moved into working position. The free ends are then lowered so that arm rests 44 are in direct pressural contact with the arms 50 and 52 of the wheel chairs and effectively lock them together during use to achieve a very stable relation. When the user wishes to separate from the table he merely raises the free end slightly and the restraint is eliminated.

The table width of 24 to 28 inches is adequate for all normal use and its comparatively great length combined with the minor longitudinal extent of the base provides an unobstructed space beneath the table sufficient to clear the full leg cast of the occupant of wheel chair 48. In addition, because there are no side obstructions, it is possible for an instructor or therapist to seat himself close beside the table to work with the patient.

When the desk is to be out of use for some time it is desirable to reduce its bulk for storage. Because of the great length of the tables it is impractical to fold them down in the manner of a drop leaf table. Instead, each table is detached from its support rail 16, turned to upright position, and set down on the base with arm rests 44 extending into the gaps 36 so that the table is stably mounted for storage. For this purpose the lateral distance between the outer margins of the longitudinal bars is slightly less than the maximum width of the recess.

Figure 8:
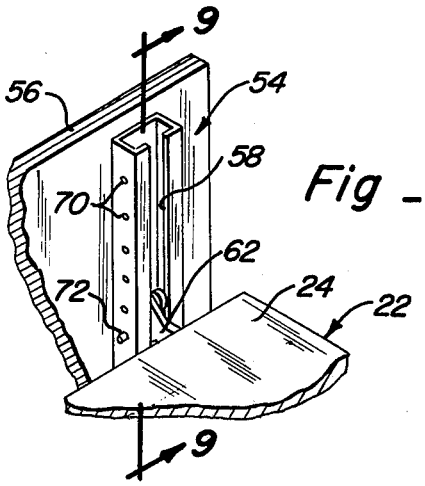
FIG. 8 is a perspective view of a second form of connector and retaining means.
Figure 9:
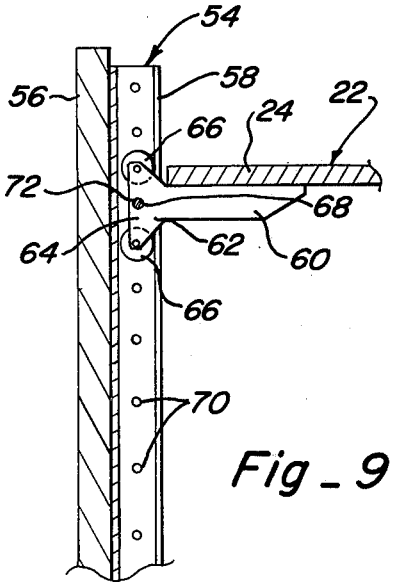
FIG. 9 is a sectional view taken on line 9—9 of FIG. 8.
Figure 10:
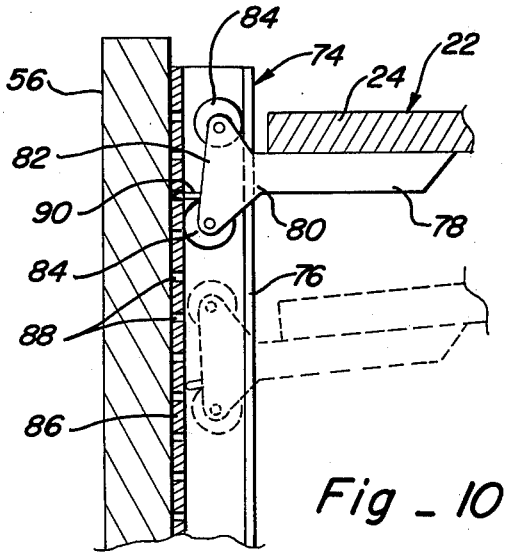
FIG. 10 is a view similar to FIG. 9, showing a third form of connector and retaining means.
Figure 11:
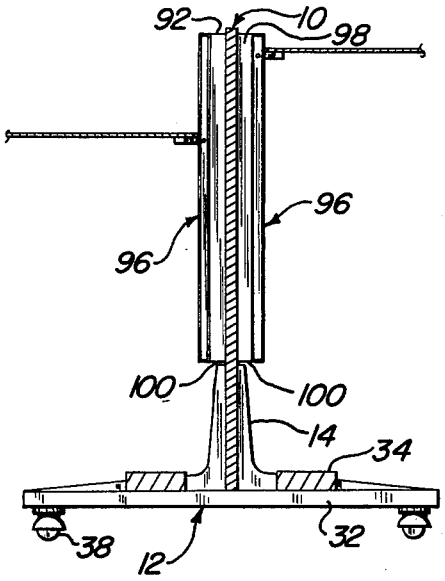
FIG. 11 is a vertical sectional view of a further modified form of the desk with a pair of tables in adjusted positions.

Alternate forms of adjustable detachable mountings for the work tables are illustrated in FIGS. 8 to 16. FIGS. 8 to 10 show the mountings in connection with a fixed vertical support such as the wall of a work room but it will be obvious that these mountings may be applied to panel 10 of FIGS. 1 to 7 and also that the mountings of FIGS. 1 to 7 and 11 to 16 may be applied to a fixed wall to provide a single desk.

In FIGS. 8 and 9 a retaining means or rail 54 is rigidly secured by screws or nails to a fixed wall 56 such as the wall of a work room in vertical attitude and a similar rail is vertically mounted to the wall in suitably spaced parallelism. The rail is in the form of a C-shaped channel open on its forward face to define a passage 58 from top to bottom. At least the upper end of the channel is left open for dismounting of the work table on occasion. A pair of connectors 60 are secured to the under side of inner end 24 of table 22, and each connector is formed with a projecting neck 62 to slide in passage 58 and a head 64 to travel within the channel. The head is provided with upper and lower pairs of rollers 66 to engage the forward and rear walls of the channel for free vertical movement of the connector. A lateral aperture 68 is formed in the head and vertically spaced apertures 70 are formed in the two side walls of the channel to receive interacting means in the form of a slidable locking pin 72. When the connector is adjusted to the desired elevation the pin is passed through corresponding apertures in the rail and the head to hold the latter in position. The rollers are slightly smaller than the fore and aft distance between the forward and rear walls of the channel to allow limited tilting movement of the free end of the work table in the manner and for the purpose described above. If desired, the locking pin may first be passed through appropriate apertures in the panel and the head lowered until the lower rollers rest on the pin.

In FIG. 10 rail 74 is rigidly secured in vertical attitude to wall 56. The rail is in the form of a C-shaped channel open on its forward face to define a passage 76 from top to bottom. At least the upper end of the channel is left open for dismounting the work table on occasion. Connector 78 is secured to the under side of inner end 24 of table 22 and is formed with a neck 80 to slide in passage 76 and a head 82 to travel within the channel. The head is provided with upper and lower pairs of rollers 84 to engage the forward and rear walls of the channel for free vertical movement of the connector. The rollers are slightly smaller than the fore and aft distance between the forward and rear walls of the channel to allow limited tilting movement of the free end of the work table in the manner and for the purpose described above and also for the locking operation of the head. The rear wall 86 of rail 74 is formed with a series of vertically spaced apertures 88 and head 82 is provided with a projection in the form of locking pin 90. When the table and connector are in the solid line position, pin 90 engages in one of the apertures 88 to hold the table at the selected elevation. When the table and connector are tilted to the broken line position pin 90 is withdrawn from the aperture and the connector can be moved to any desired level or raised out of the top of the channel to dismount the table.

In the modification shown in FIGS. 11 to 16, a generally rectangular elongate support plate 92 is mounted in vertical position on each side edge of support panel 10 in a plane perpendicular to the plane of panel 10 by any suitable means such as screws 94, the vertical marginal edges of each plate being spaced several inches out from the face of panel 10. As in the forms previously described, a support rail 96 is provided at each side of the panel and located along the marginal edges of plate 92. The space 98 between the rails and the panel serves as a storage pocket for a table. Flanges 100 at the lower edges of the plates serve as stops to prevent the tables from falling through the bottoms of the pockets.

Figure 14:
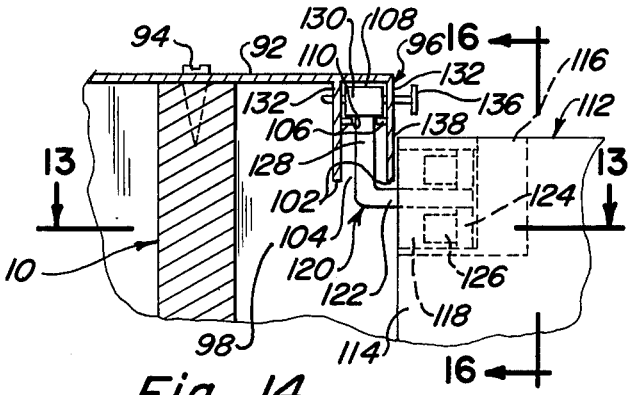
FIG. 14 is a fragmentary sectional view taken on line 14—14 of FIG. 13.
Figure 12:
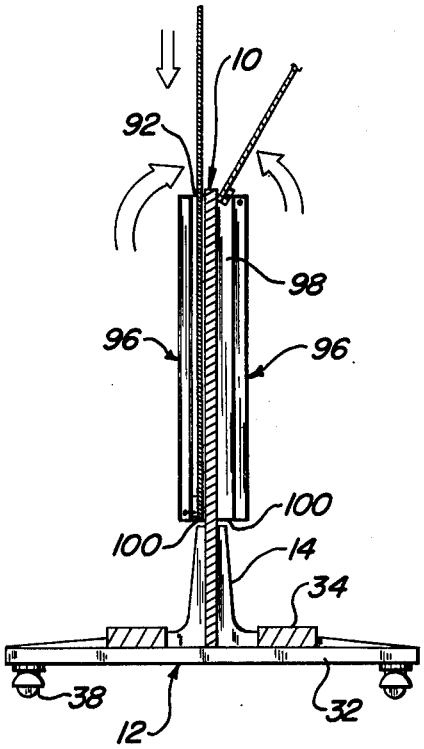
FIG. 12 is a view similar to FIG. 11, showing one table in a storage pocket and one table about to be inserted in the other storage pocket.

As indicated in FIG. 14, each rail is in the form of a deep channel with its free marginal edges 102 defining a continuous open passage 104 from top to bottom facing inward toward the centerline of the desk and consequently toward the open passage of the opposite rail. Longitudinal webs 106 within the channel extend toward each other to form a substantially closed guide track 108 with a narrow longitudinal passage 110.

Work table 112 is substantially identical to the table 22 of the previous embodiments and is provided at the corners of its inner end 114 with abutment blocks 116 connected to its under side. Each block is formed with a recess 118. An L-shaped link 120 has a first leg 122 extending parallel to the longitudinal axis of the table into the recess and a cross bar 124 is secured to its free end. A pair of straps 126 secured to the table and the abutment partly surround the cross bar and cooperate with the abutment and the table to provide a laterally directed horizontal pivotal mounting for the cross bar and the link. The second leg 128 extends laterally through the passages 104 and 110 into the guide track 108 and is provided at its free end with a roller 130 to travel in the guide track. Since the width of passage 110 is much less than the diameter of the roller there is no possibility of accidental displacement of the roller from the track. The two side walls 132 of the channel are provided with a series of vertically spaced apertures 134 to selectively receive interacting means in the form of locking pin 136.

Figure 13:
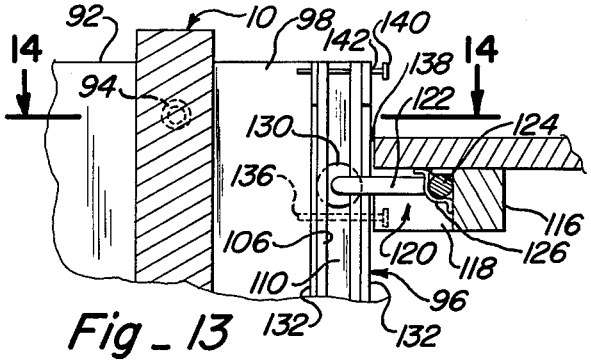
FIG. 13 is a fragmentary sectional view of a table in mounted position taken on line 13—13 of FIG. 14.

Considering FIGS. 13 and 14 particularly, it will be seen that the table may be mounted at a desired elevation by raising it momentarily in a generally horizontal attitude, inserting locking pin 136 in a selected pair of apertures 134, and then lowering the table until roller 130 rests on pin 136 in each of the rails. The engagement of the lower forward edge of each abutment 116 with the face of channel wall 132 maintains the table in substantially horizontal attitude. The length of leg 122 and the depth of recess 118 are correlated to provide a small gap 138 between the edge of the table and abutment and the adjacent face of channel wall 132. This gap is sufficient to allow the raising and lowering of the free end of the table a few inches in order to provide the desired contact between the arm rests 44 of the table and the arms 50 of a wheel chair as previously described.

Figure 15:
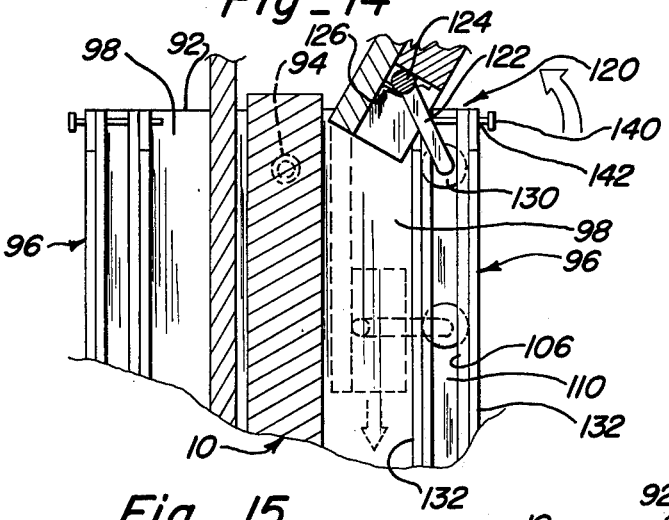
FIG. 15. is a view similar to FIG. 13 showing a table in transfer position.

With the present embodiment of the invention it is not necessary to disconnect the table from the rails in order to store it during a period of non-use. A stop member in the form of a bolt or pin 140 is inserted through aligned apertures 142 in the extreme upper ends of walls 132 at the upper end of guide track 108 to prevent release of roller 130. When it is desired to store the table, it is raised in horizontal attitude until the roller reaches the top of the track and engages pin 140. As illustrated in FIG. 15, the table can now be tilted about both pivotal axes of link 120 until the forward edge of the table and abutment move across the rail and into pocket 98, after which the table is lowered until it contacts flanges 100 at the bottom of the pocket, as indicated in the left hand portion of FIG. 15.

Figure 16:
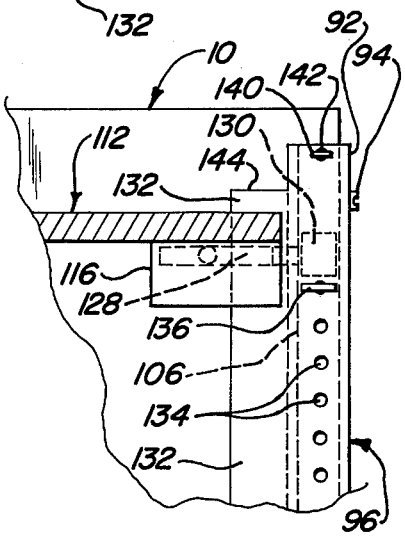
FIG. 16 is a fragmentary elevational view, partly in section taken on line 16—16 of FIG. 14.

It will be apparent that the geometry of the table support and connection is such that the inner edge of the table and abutment cannot clear the extreme upper end of the rail. Turning to FIG. 16, it will be seen that the side edges of the table are slightly inward of webs 106 and that the free edge portions of channel walls 132 at their upper ends are cut away at 144 a sufficient distance vertically to provide adequate clearance for the table and abutment to swing over the cutaway potions while the lock pins 140 prevent the roller from leaving the guide track. Thus the table and support may remain in assembled relation at all times. When it is again desired to use the table it is merely raised out of the pocket and swung to its outer position. Locking pins 136 are inserted in selected apertures and the table is lowered to working position. If at any time it is desired to separate the table from the support for any reason, lock pins 140 are readily removable to clear the upper end of the guide track.

What is claimed is:

1. A desk for handicapped persons confined to wheel chairs comprising:

an upright generally planar support member having retaining means extending generally vertically for adjustably receiving connectors;

a generally planar narrow elongate work table having two lateral end edges and two longitudinal side edges substantially longer than the end edges;

connectors secured to a first end of the table and constructed to engage the retaining means on the support member for vertical adjustment thereon to support the table at variable levels in a substantially horizontal attitude and to disengage the retaining means on occasion;

a recess formed centrally in the second, free end edge of the table to accommodate the torso of a person occupying a wheel chair and to define at each side of the recess an arm rest for the occupant;

the table arm rests being so located as to overlie the arms of a wheel chair when the occupant is in working position and stabilize the table with respect to the wheel chair.

2. A desk as claimed in claim 1; in which the table is in the form of a thin panel with the space beneath the panel being substantially free of obstructions to facilitate the locating of a wheel chair in proper selected position with respect to the work table.

3. A desk as claimed in claim 1; in which the interengagement of the connectors and the retaining means provides limited pivotal movement of the table about a lateral axis adjacent to the support member to facilitate raising of the free end of the table and lowering of the arm rests into contact with the arms of the wheel chair to stabilize the table and to restrain the wheel chair against unintentional displacement.

4. A desk as claimed in claim 1; in which the retaining means comprise a pair of laterally spaced vertically extending support rails and the table is provided with a pair of similarly spaced connectors, each engaging one rail;

and interacting means are provided between the connectors and the rails to retain the connectors in selected positions on the rails.

5. A desk as claimed i claim 4; in which the rails are provided with vertically spaced apertures and the connectors are provided with projections to engage selected apertures in the rails.

6. A desk as claimed in claim 5; in which each connector is provided with at least one hook to engage and interlock with a selected aperture in its corresponding rail.

7. A desk as claimed in claim 5; in which each rail is in the form of a C-shaped channel having a continuous open passage in its forward face and a series of vertically spaced apertures in its rear wall;

each connector has a neck portion to slide in the passage and a head provided with a plurality of vertically spaced rollers to be located within the channel for free vertical movement of the connector;

the rollers being smaller than the fore and aft depth of the channel to permit limited pivotal movement of the connector about a lateral axis;

and a locking pin projecting from the head and located to engage a selected aperture in the rear wall with the table in substantially horizontal position and to disengage the aperture in response to upward tilting of the table.

8. A desk as claimed in claim 4; in which each rail is in the from of a C-shaped channel having a continuous open passage in its forward face and a series of vertically spaced apertures in its laterally spaced side walls;

each connector has a neck portion to slide in the passage and a head provided with a plurality of vertically spaced rollers to be located within the channel for free vertical movement of the connector;

and a locking pin is provided to pass through selected apertures in the side walls and engage the head to support the connector at a selected elevation.

9. A desk as claimed in claim 1; in which the support member is in the form of a panel, and a generally horizontal base is provided to support the panel in vertical position;

vertically extending retaining means are provided on both faces of the panel;

and a work table is mounted on each face of the panel.

10. A desk as claimed in claim 9; in which the base is mounted on rollers to facilitate movement of the desk to a location adjacent to a wheel chair.

11. A desk as claimed in claim 1; in which the support member is in the form of a panel, and a generally horizontal base is provided to support the panel;

the panel extends laterally across the base from side to side and is rigidly secured thereto in vertical attitude;

and the base is formed with a recess at each side cooperating with the panel to define a gap at each side of the base to receive the arm rests of a dismounted work table to facilitate stable storage of the table on the base in an upright attitude adjacent to the panel.

12. A desk as claimed in claim 11; in which the panel is provided with retaining means on both vertical faces and is mounted to extend across the central portion of the base;

and the recesses in the sides of the base extend to both sides of the panel to define a pair of gaps at each side of the panel to store two work tables on the same base with the support member panel extending vertically upward between them.

13. A desk as claimed in claim 1; in which the support member is in the form of a panel, and a generally horizontal base is provided to support the panel the base includes a pair of laterally spaced longitudinally extending primary support bars;

the panel extends laterally across the central portions of the bars and is rigidly secured thereto in vertical attitude;

and a cross bar extends across the longitudinal bars at each side of the panel and in a position spaced from and parallel to the bottom of the panel and is secured to the longitudinal bars to produce a rigid base structure;

the total length of the base being only a minor portion of the length of the work table so as to provide a totally unobstructed floor area beneath the outer portion of the work table.

14. A desk as claimed in claim 13; in which a roller is provided at each end of each longitudinal bar to facilitate movement of the desk to a location adjacent to a wheel chair.

15. A desk as claimed in claim 13; in which the distance between the outer margins of the longitudinal bars is less than the width of the recess in the work table to provide a gap at each side of the base between the cross bar and the bottom of the panel to receive the arm rests of a dismounted work table to facilitate stable storage of the table on the base in an upright attitude adjacent to the panel.

16. A desk as claimed in claim 1; in which the retaining means comprise a pair of laterally spaced vertically extending support rails and the table is provided with a pair of similarly spaced connectors, each engaging one rail;

and interacting means are provided between the connectors and the rails to retain the connectors in selected positions on the rails;

each rail is in the form of an elongate channel having a continuous open passage facing the continuous open passage of the opposite rail;

each connector is in the form of an L-shaped link having a first leg extending parallel to the longitudinal axis of the work table and pivotally connected thereto at its free end for rotation about a horizontal axis and a second leg extending laterally into the channel and provided at its free end with a roller to travel vertically in the channel;

each channel has a plurality of vertically spaced apertures in its side walls;

and the interacting means comprise a pair of locking pins to pass through selected apertures in the rails and serve as abutments to engage the rollers and support them at a desired elevation.

17. A desk as claimed in claim 16; in which the underside of the table adjacent to the connectors is provided with abutments to engage the confronting faces of the rails and prevent excessive downward tilting of the free end of the table.

18. A desk as claimed in claim 17; in which the rails are arranged in a general plane spaced from the plane of the support member of define a storage pocket between them and the support member;

stop means are provided at the upper end of each channel to prevent release of the rollers;

and the free edge portions of the channels at their upper ends are cut away to provide clearance for the table end and its abutments to swing over the cutaway portions and descend into the storage pocket.

19. A desk as claimed in claim 18; in which the stop means are removable to permit the rollers to leave the channels and to disconnect the table from the rails.

20. A desk as claimed in claim 1; in which the length of the work table is in the range of 150 to 200 percent of the width of the table.

* * * * *